US011353166B2

(12) United States Patent
Li et al.

(10) Patent No.: US 11,353,166 B2
(45) Date of Patent: Jun. 7, 2022

(54) CIRCUIT BOARD ARRANGEMENT TO PREVENT OVERVOLTAGE AND ARCING

(71) Applicant: SIGNIFY HOLDING B.V., Eindhoven (NL)

(72) Inventors: Zhaoting Li, Eindhoven (NL); Peng Chen, Eindhoven (NL); Han Lu, Eindhoven (NL); Feng Wang, Eindhoven (NL); Wei Xia, Eindhoven (NL); Yun Wang, Eindhoven (NL); Ai Ling Xu, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/254,949

(22) PCT Filed: Jun. 18, 2019

(86) PCT No.: PCT/EP2019/065960

§ 371 (c)(1),
(2) Date: Dec. 22, 2020

(87) PCT Pub. No.: WO2020/002040

PCT Pub. Date: Jan. 2, 2020

(65) Prior Publication Data

US 2021/0127468 A1 Apr. 29, 2021

(30) Foreign Application Priority Data

Jun. 28, 2018 (WO) ..... PCT/CN2018/093386
Aug. 30, 2018 (EP) ..... 18191647

(51) Int. Cl.
*H05B 45/34* (2020.01)
*H05B 45/54* (2020.01)
(Continued)

(52) U.S. Cl.
CPC ..... *F21K 9/278* (2016.08); *H05B 45/34* (2020.01); *H05B 45/40* (2020.01); *H05B 45/54* (2020.01)

(58) Field of Classification Search
CPC ..... F21K 9/278; H05B 45/00; H05B 45/34; H05B 45/40; H05B 45/54; H05B 47/24; Y02B 20/30
See application file for complete search history.

(56) References Cited

U.S. PATENT DOCUMENTS 9,970,639 B2 * 5/2018 Yadav ..... F21V 23/005
2011/0121756 A1 5/2011 Thomas et al.
(Continued)

FOREIGN PATENT DOCUMENTS

CN 102011953 A * 4/2011 ..... H05B 45/375
CN 107105545 A 8/2017
DE 102012002710 A1 * 8/2013 ..... F21K 9/175

*Primary Examiner* — Henry Luong
(74) *Attorney, Agent, or Firm* — Daniel J. Piotrowski

(57) ABSTRACT

A circuit board arrangement assembled by at least a first and a second circuit boards, each circuit board comprising: a portion of a circuit; and a first and a second electrical terminals to be electrically connected to a respective first and a second electrical terminals of the other circuit board of the first and the second circuit boards, so as to couple the portions of the circuit of the first and the second circuit boards, wherein the first and second electrical terminals on the circuit board are coupled with each other via the portion of the circuit on the other circuit board of the first and the second circuit boards, at least one board further comprising: a voltage suppression element (TSS1, TSS2) in the board connected across the first and second electrical terminals of the board, said voltage suppression element (TSS1, TSS2) is adapted to become conductive when a voltage thereacross reaches a threshold; characterized in that the portion of the circuit comprising at least one LED, and said LED (LED1)
(Continued)

of the first circuit board (B1) and said LED (LED4) of the second circuit board (B2) are forwarded in the same direction and to be series connected between a first interconnection (LED+) of the first electrical terminals of the first and the second circuit boards and a second interconnection (LED−) of the second electrical terminal of the first and the second circuit boards. The voltage suppression element is able to prevent overvoltage/arcing due to a disconnection of the series connection of the LEDs of the first and second circuit boards, as well as a disconnection of a interconnection of first terminals, and a interconnection of the second terminals.

11 Claims, 2 Drawing Sheets

(51) Int. Cl.
*F21K 9/278* (2016.01)
*H05B 45/40* (2020.01)

(56) References Cited

U.S. PATENT DOCUMENTS

| | | | | |
|---|---|---|---|---|
| 2015/0062888 | A1 | 3/2015 | Kim et al. | |
| 2015/0351171 | A1* | 12/2015 | Tao | F21K 9/278 315/185 R |
| 2016/0081147 | A1 | 3/2016 | Guang | |
| 2017/0094746 | A1 | 3/2017 | Xiong et al. | |
| 2017/0321849 | A1 | 11/2017 | Xiong et al. | |

* cited by examiner

CIRCUIT BOARD ARRANGEMENT TO PREVENT OVERVOLTAGE AND ARCING

CROSS-REFERENCE TO PRIOR APPLICATIONS

This application is the U.S. National Phase application under 35 U.S.C. § 371 of International Application No. PCT/EP2019/065960, filed on Jun. 18, 2019, which claims the benefits of European Patent Application No. 18191647.9, filed on Aug. 30, 2018 and Chinese Patent Application No. PCT/CN2018/093386, filed on Jun. 28, 2018. These applications are hereby incorporated by reference herein.

FIELD OF THE INVENTION

This invention relates to LED lighting, more particularly to safety in LED lamps.

BACKGROUND OF THE INVENTION

Nowadays integration of electronic component in printed circuit boards (PCB) is a widely used technology. Sometimes the application requires an abnormal shape, like very long shape. This is not easy to implement by a single PCB. For example, in LED tubular lamp/LED tube, the PCB carrying the LEDs and the driver circuit needs to be shaped to be a long shape. A single PCB is not easy to manufacture to fulfill this need.

Many LED tubular lamps use several PCBs and use, soldering, cables or connectors to electrically connect those PCBs so as to provide the long shape. After used for a long time, especially in an environment with vibrations, the connection becomes weak and might be broken by accident. LED tubular lamps are often used with traditional electronic ballasts to replace the fluorescent lamps. The electronic ballasts are constant current sources which can generate high voltage whose peak value up to 1300 volt if the output impedance become large due to broken connector or cable. If this high voltage added to the air gap of the broken connector or cable, constant arcing could happen. Electric arc generates heat which can make PCB carbonize and catch fire. That will lead to LED lamps catching fire. There have been fire accidents caused by arcing on LED tubular lamps reported. But there is no solution to prevent arcing on market until now.

US20160081147A1 discloses an LED driver circuit, with its driver circuitry split onto two PCBs: a rectifier and filter circuit PCB 18, and a step-down constant current circuit is on PCB 19. A varistor RV is provided in the filter circuit 40.

U.S. Pat. No. 9,970,639B2 shows different LED boards 220 and 210 are connected by connector, and LED array of the LED boards are connected in parallel with each other, to a same driving channels.

D3 US20150351171A1 discloses a tubular LED lamp with different circuit boards, wherein rectifier diodes are placed in one board, and all LEDs are series connected and placed in another board.

SUMMARY OF THE INVENTION

The basic idea of the embodiments of the invention is that adding voltage suppression elements in a circuit board across the terminals of the board to another board, the LED on the board and the another board are series connected and same-direction forward across the terminals, thus even if a power path formed by the interconnection of the terminals is broken at the middle of the series connection of the LEDs of different boards, the voltage suppression element is able to shunt a voltage across the terminals, thereby suppressing the voltage on the broken point at the middle of the series connected LEDs of different boards and avoid arcing there. None of the above mentioned prior art relates to a problem of arcing at a broken point at the middle of the series connected LEDs of different boards. Even if it is known to place LEDs on different boards and series connect the LEDs of different boards, a combination of it (series connect the LEDs of different boards) and the voltage suppression element across the terminals still solves the above technical problem that none of the known prior art intends to solve and achieves a technical effect of preventing arcing in the series LEDs connected by the connected boards. Thus this basic idea is unobvious over any of the above mentioned prior arts, their combination, as well as taking other known technology into consideration.

According to a basic embodiment, it is provided a circuit board arrangement assembled by at least a first and a second circuit boards, each circuit board comprising: a portion of a circuit; and a first and a second electrical terminals to be electrically connected to a respective first and a second electrical terminals of the other circuit board of the first and the second circuit boards, so as to couple the portions of the circuit of the first and the second circuit boards, wherein the first and second electrical terminals on the circuit board are coupled with each other via the portion of the circuit on the other circuit board of the first and the second circuit boards, at least one circuit board of the first and the second circuit boards further comprising: a voltage suppression element in the circuit board connected across the first and second electrical terminals of the board, said voltage suppression element is adapted to become conductive when a voltage thereacross reaches a threshold; characterized in that the portion of the circuit comprising at least one LED, and said LED of the first circuit board and said LED of the second circuit board are forwarded in the same direction and to be series connected between a first interconnection of the first electrical terminals of the first and the second circuit boards and a second interconnection of the second electrical terminal of the first and the second circuit boards.

In this embodiment, the voltage stress across the portion including the LEDs, coupling the first and second electrical terminals of one board, is reduced by the voltage suppression element across the first and second electrical terminals. Arcing does not likely to happen between/in the middle of the series connection of the LEDs of the different boards in case the different boards disconnected, and fire risk of the circuit board arrangement, assembled by different boards, are mitigated.

In a preferred embodiment, the voltage suppression element is adapted to become conductive when a voltage across the series connection of the LED on the first circuit board and the LED on the second circuit board reaches the threshold, thereby preventing an overvoltage/arcing across the first and second electrical terminals due to a disconnection of the series connection of the LED on the first circuit board and the LED on the second circuit board.

In a further embodiment, the voltage suppression element is adapted to voltage suppression element is further adapted to become conductive when a voltage across the first interconnection or the second interconnections reaches the threshold thereby preventing an overvoltage/arcing due a disconnection of the first interconnection of the first electrical terminals or a disconnection of the second interconnection of the second electrical terminals.

In this embodiment, the voltage from the input supply would be shunted by the voltage suppression element thus would not develop across the potential disconnection of the first terminals between the different boards, or would not develop across the potential disconnection of the second terminals between the different boards. More specifically, the disconnection of the first terminals of different boards is protected from overvoltage; and so is the disconnection of the second terminals of different boards.

In an even further embodiment, each circuit board comprising a third electrical terminal to be connected to a third electrical terminal of the other of the first and the second circuit boards, the LED on the first board is forwarded from the first electrical terminal to the third electrical terminal, the LED on the second board is forward from the third electrical terminal to the second electrical terminal, thereby the first interconnection of the first electrical terminals and the second interconnection of the second electrical terminals are in series connection with each other via the third interconnection of the third electrical terminals and the LEDs, and a LED current is adapted to flow from the first interconnection, through the LED on one of the first and the second circuit boards, through the third connection, through the LED on the other of first and the second circuit boards, and to the second interconnection.

Preferably the voltage suppression element is adapted to prevent an overvoltage/arcing across the third interconnection. Therefore the voltage from the input supply would not develop across the potential disconnection of the third terminals.

In a more specific embodiment of LED lamp, the first circuit board comprises: a first input adapted to connect to a first output of an AC power supply; a first half of a rectifier, connected with the first input and with a positive line and a negative line, wherein said positive line and the negative line are connected to the first and second terminals respectively; a first LED path connected from the positive line to the third electrical terminal; and the second circuit board comprises: an second input adapted to connect to a second output of an AC power supply; a second half of the rectifier, connected with the second input and with the positive line and the negative line, wherein said positive line and the negative line are connected to the first and second terminals respectively; a second LED path connected from the third electrical terminal to the negative line; each of the first LED path and the second path comprise a plurality of LEDs.

This embodiment provides an implementation to allocate the LED lighting circuit on the different boards. The different boards are with rectifier halves. Preferably, the different boards both have LED segment that in series connection to form the whole LED path. Therefore in this sense, the different boards are symmetrical. In order to connect these circuit portions, interconnections of terminals on the different boards are provided, and the arcing/overvoltage of the disconnection of the interconnections can be protected by the voltage suppression element.

In one embodiment, the first circuit board comprises: a first of the voltage suppression element connected across the positive and negative lines, and adapted to prevent an overvoltage/arcing in case of: the third interconnection of the third electrical terminals fails; and the second interconnection of the second electrical terminals fails and the second input has a positive phase of the AC power supply.

Alternatively or additionally, the second circuit board comprises: a of the second voltage suppression element connected across the positive and negative lines and adapted to prevent an overvoltage/arcing in case of: the third interconnection of the third electrical terminals fails; and the first interconnection of the first electrical terminals fails and the second input has a positive phase of the AC power supply.

One voltage suppression element is provided on one circuit board arrangement for safety. More preferably, both circuit boards comprise a respective voltage suppression element for even safer protection against arcing in various interconnections in the LED lamp.

In an alternative allocation of the LED lighting circuit on the different boards, as a basic structure, a circuit board arrangement assembled by a first and a second circuit boards, each circuit board comprising: a portion of a circuit; and a first and a second electrical terminals to be electrically connected to a respective first and a second electrical terminals of the other circuit board of the first and the second circuit boards, so as to couple the portions of the circuit of the first and the second circuit boards, wherein the first and second electrical terminals on the circuit board are coupled with each other via the portion of the circuit on the other circuit board, at least one circuit board of the first and the second circuit boards further comprising: a voltage suppression element (TSS1, TSS2) connected across the first and second electrical terminals of the circuit board, said voltage suppression element (TSS1, TSS2) is adapted to become conductive when a voltage thereacross reaches a threshold. Further, the first circuit board comprises: a first input adapted to connect to a first output of an AC power supply; a full rectifier, connected to the first input and to the third electrical terminal as input, and having a positive line and a negative line as output, wherein said positive line and the negative line are connected to the first terminal and second terminal respectively; a first voltage suppression element connected across the positive and negative lines; and the second circuit board comprises: a third terminal that is adapted to couple to a second output of an AC power supply, said third terminal is connected to the third electrical terminal of the first circuit board; and a LED path connected from the first terminal to the second terminal.

In this embodiment, the rectifier, with optional driver circuit, is placed in the first board, and the LEDs are placed in the second board. This enables a clear functionally separation of the whole lighting circuit, and facilitates thermal requirement of the boards. Since there are interconnections of the boards, the voltage suppression element is provided across the first and second terminals of the first board, also across the output of the full rectifier for safety. Therefore, if the output of the full rectifier becomes open due to disconnection, the voltage suppression element will activate to short circuit the full rectifier's output and prevent voltage.

In a more preferable embodiment, the second circuit board further comprises: a second voltage suppression element connected between the second terminal and the third terminal, wherein said second voltage suppression element is adapted to detect voltage in AC, the third terminal in the second circuit board is a second input of the circuit board arrangement; and said first voltage suppression element is adapted to detect voltage in DC.

In this embodiment, the second voltage suppression element is coupled to the other input to the power supply thus can bypass the rectifier partially. In case of a disconnection between the input of the rectifier in the first circuit board and the second output of the AC power supply, the power supply can be shunted by the second voltage suppression element to bypass the disconnection/partially the rectifier. Thus arcing between the disconnection between the rectifier and the AC power supply is prevented.

In an alternative embodiment, the lighting circuit is further allocated to three boards, and the circuit board arrangement further comprises a third circuit board comprising: a second input to be connect to a second output of an AC power supply, a third terminal connected to the second input and connected to the third terminal of the second circuit board, a second terminal connected to a second terminal of the second circuit board, and a second voltage suppression element connected between the second terminal and the third terminal, wherein said second voltage suppression element is adapted to detect voltage in AC.

In this embodiment, the lighting circuit is further functionally separated. The second board now only carries the LED, and the second input of the lamp and the second voltage suppression element are placed in a different third board.

Said second voltage suppression element is adapted to prevent an overvoltage/arcing in case that the interconnections of the third terminals, either between the first and second boards or between the second and the third boards, fail.

The second voltage suppression element is able to shunt the rectifier to the second output of the AC power supply in case of a disconnection between the input of the rectifier in the first circuit board and the second output of the AC power supply, which disconnection may occur either between the first circuit board and the second circuit board, or between the second circuit board and the third circuit board.

Preferably, the voltage suppression element is adapted to become zero resistance when the voltage thereacross reaches the threshold, and comprises a transient surge suppressor like a glass discharge tube/spark gap protector (SPG), thyristor surge suppressor (TSS), or a gas discharge tube (GDT). Those devices are low cost and reliable to ensure the safety of the LED lamps.

Preferably, the first terminals are connected by soldering, wiring or connector, said second terminals are connected by soldering, wiring or connector, and said third terminals are connected by soldering, wiring or connector. The voltage suppression element can well protect the risk in case of a disconnection of those connect mechanisms.

The embodiment of the invention also provides a tubular LED lamp, comprising the circuit board arrangement according to the above aspects.

Preferably, the tubular LED lamp is used with an electronic ballast for fluorescent lamps. The tubular LED lamp can overcome the fire risk due to a disconnection given the electronic ballast's constant output current, and has broad use cases.

Preferably, said first circuit board and the second circuit board are sequentially along the longitudinal direction of the tubular LED lamp, and the first terminals and the second terminals are connected at a longitudinal location in the tubular LED lamp with a distance from the ends of the lamp.

Due to the length of the tubular lamp, the boards are placed sequentially along the longitudinal direction of the lamp, and the interconnections of the terminals are placed between the two ends of the tubular lamp which makes it more vulnerable to shock/vibration. The present embodiments of the invention can provide safety countermeasure thus the tubular lamp is safer.

In case that there are three boards, said first, second and third circuit boards are placed sequentially along the longitudinal direction of the tubular LED lamp, said first circuit board and the third circuit board are placed in opposite ends of the tubular LED lamp, the second circuit is placed between the first and the third circuit boards, and the first terminals, the second terminals and the third terminals are connected respectively at a longitudinal location in the tubular LED lamp with a distance from the ends of the lamp.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

The basic idea of the embodiments of the invention is using a voltage suppression element across a first and a second terminals of a circuit board, wherein the first and second terminals are to be connected to a first and a second terminals respectively of another circuit board to assemble a whole circuit board arrangement. The first and second terminals of one circuit board is also connected via a portion of the another circuit board. Thus in case of a disconnection of first terminals, the second terminals, or any other connections between the first and the second terminals, the voltage suppression element would activate to shunt the first and the second terminals in the one board, as well as the voltage from the power supply, and protect the disconnection from overvoltage/arcing.

The following description is based on an application of the invention in tubular LED lamps used with traditional electronic ballast for fluorescent lamp. Note that this is not limiting. A lamp to be used with ballast for HID lamps can also use the embodiment of the invention. More generally, a circuit board arrangement in any other electrical appliances can also use embodiments of the invention for protection, as long as the circuit board arrangement is assembled from multiple circuit boards with electrical terminals thereof interconnected.

Figure 1:
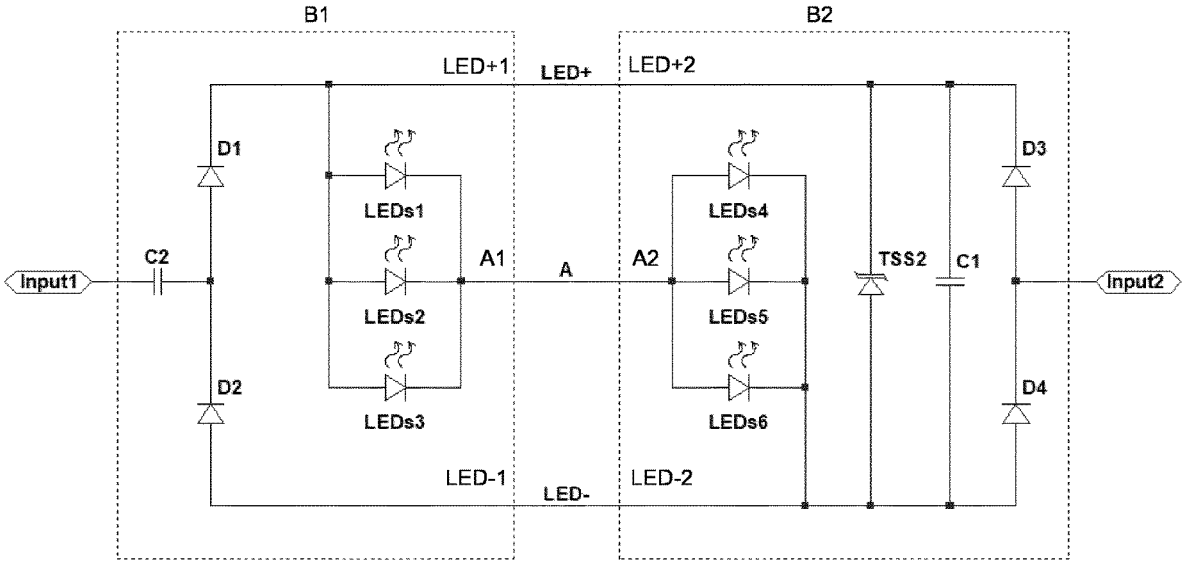
FIG. 1 shows a diagram of an embodiment of the invention.

FIG. 1 shows an embodiment of the invention. The lamp comprising a first input Input1 and a second input Input2 to be connected to an AC ballast which is the traditional electronic ballast for fluorescent lamps. An optional capacitor C2 is in series with the first input, thereby in series with the ballast output to limit the ballast's output current. A full rectifier bridge D1, D2, D3 and D4 is provided to rectify the AC power from the ballast into a DC power across a positive line LED+ and a negative line LED−. The LED string is schematically illustrated by LED1, LED2, LED3, LED4, LED5 and LED6, wherein LED1, LED2 and LED3 are connected in parallel, LED4, LED5 and LED6 are connected in parallel, and the two parallel branches are connected in series. Note this does not limit the real implementation of the LED string. For example, the LED1 could stand for a plurality of LEDs. Since the tubular lamp is quite long, the circuit is allocated on two different circuit boards B1 and B2.

The dash block illustrates which circuit components are placed on which circuit boards. More specifically, the first circuit board B1 comprises the first input Input1 adapted to connect to a first output of an AC power supply;

a first half D1, D2 of the rectifier, connected with the first input and with the positive line LED+ and the negative line LED−, wherein said positive line and the negative line are connected to the first terminal LED+1 and second terminal LED−1 of the first circuit board respectively;

a first LED path connected from the positive line to an electrical terminal A1. The second circuit board B2 comprises the second input Input2 adapted to connect to a second output of an AC power supply;

a second half D3, D4 of the rectifier, connected with the second input and with the positive line LED+ and the negative line LED−, wherein said positive line and the negative line are connected to the first terminal LED+2 and second terminal LED−2 of the second circuit board respectively;

a second LED path connected from an electrical terminal A2 to the negative line.

Wherein, the first terminal LED+1 of the first board is connected to the first terminal LED+2 of the second board; the second terminal LED−1 of the first board is connected to the second terminal LED−2 of the second board. They complete the rectifier. The third terminal A1 of the first board is connected to the third terminal A2 of the second board to complete the LED string.

The second circuit board B2 comprises a second voltage suppression element, shown as TSS2, across the first terminal LED+2 and the second terminal LED−2. When the first interconnection of the first terminals LED+1 and LED+2 fails, in case the second input Input2 receives positive voltage in the AC supply power, the second voltage suppression element TSS2 becomes conductive and shunts the positive voltage to the negative line and to the first input Input1, back to the ballast. There is no overvoltage/arcing across a disconnection of the LED+ line. Moreover, when the third interconnection of the third terminals A+ and A− fails, the second voltage suppression element TSS2 becomes conductive and shunts the positive voltage to the negative line, and the ballast output is shunted without applying on the disconnection of A on the LED string. There is no overvoltage/arcing on the disconnection of A.

Figure 2:
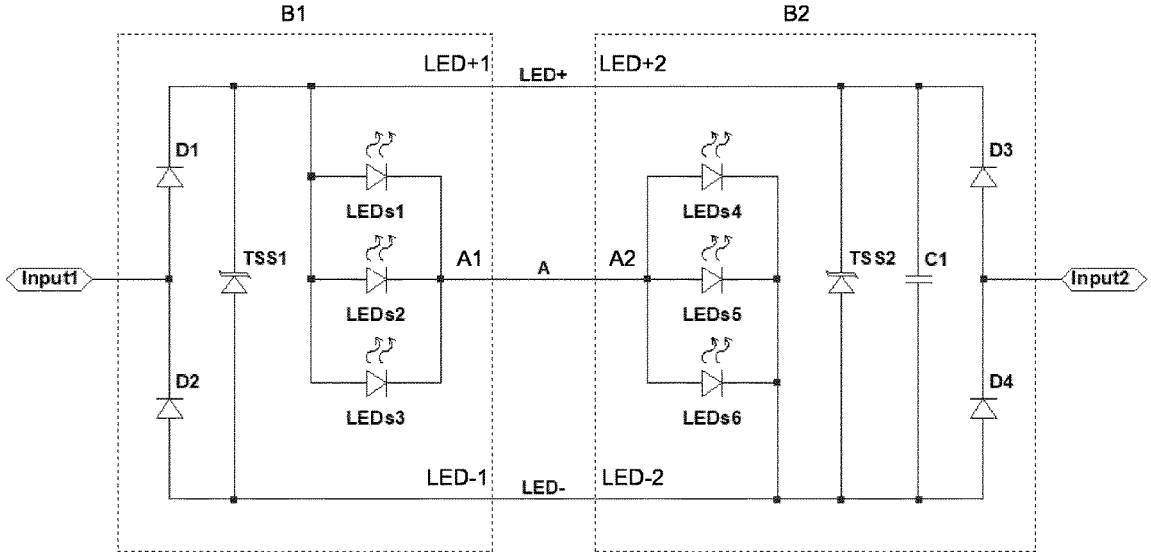
FIG. 2 shows a diagram of a modified implementation of the embodiment in FIG. 1.

FIG. 2 shows a further modified embodiment based on the embodiment of FIG. 1, wherein the first circuit board B1 is also provided with a first voltage suppression element TSS1 across the first terminal LED+1 and the second terminal LED−1. When the second interconnection of the second terminals LED−1 and LED−2 fails, in case the second input Input2 receives positive voltage, the first voltage suppression element TSS1 becomes conductive and shunts the positive voltage to the negative line and to the first input Input1 back to the ballast. There is no overvoltage/arcing across a disconnection of the LED− line. Moreover, when the third interconnection of the third terminals A+ and A− fails, the first voltage suppression element TSS1 also activate together with the second voltage suppression element TSS1 as discussed above to shunt the positive voltage to the negative line.

In the above embodiments, the allocation of the LED lighting circuit is symmetrical on the first and the second circuit board whereas each board has a half of the rectifier and a part of the LED string. Note that LED string can be placed only in the first board B1 or the second board B2.

In real tubular LED lamps, said first circuit board and the second circuit board are placed sequentially along the longitudinal direction of the tubular LED lamp, and the first terminals and the second terminals are connected at a longitudinal location in the tubular LED lamp with a distance from the ends of the lamp.

Figure 3:
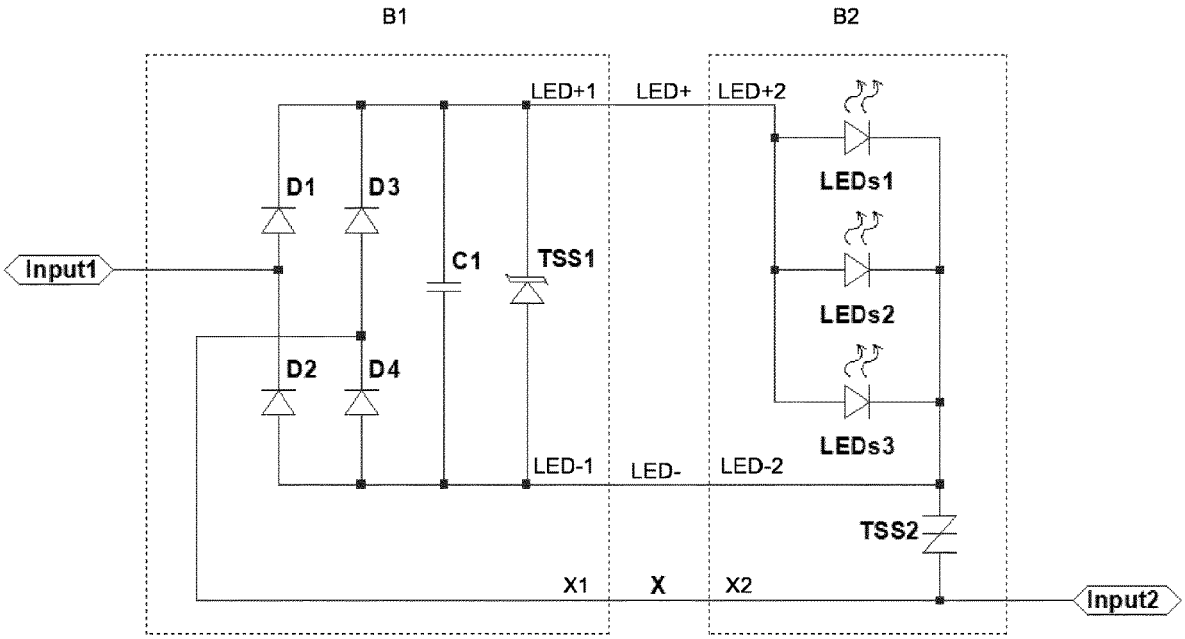
FIG. 3 shows a diagram of an alternative embodiment of the invention.

Besides the above symmetrical allocations, there are asymmetrical allocations of the lighting circuit among the circuit boards. As shown in FIG. 3, the rectifier is placed on a first circuit board B1 only and the LED string is placed on a second circuit board B2 only. In order to connect the LED string to the rectifier, a first interconnection of the rectifier's positive output LED+1 and the LED string's anode LED+2, and a second interconnection of the LED string's cathode LED−2 and the rectifier's negative output LED+2 are provided. The first input Input1 is on the first board, and the second input Input2 is on the second board. In order to connect the second input Input2 to the rectifier in the first board, an interconnection X of a third terminal X1 in the first board and X2 in the second board is provided.

A first voltage suppression element TSS1 is provided in the first circuit board B1 and connected across the rectifier's positive and negative output. In case any or both of the first and second interconnections LED+ and LED− fail, the first voltage suppression element TSS1 would activate.

A second voltage suppression element TSS2 is provided in the second circuit board and connected across the second terminal LED−2 and the third terminal X2/the second input Input2. In case the third interconnection X fails, the second voltage suppression element TSS2 would activate. Note the second voltage suppression element TSS2 is preferably bi-directional and able to activate with AC signal. The first voltage suppression element TSS1 may be unidirectional since it is already on the DC side of the rectifier.

Figure 4:
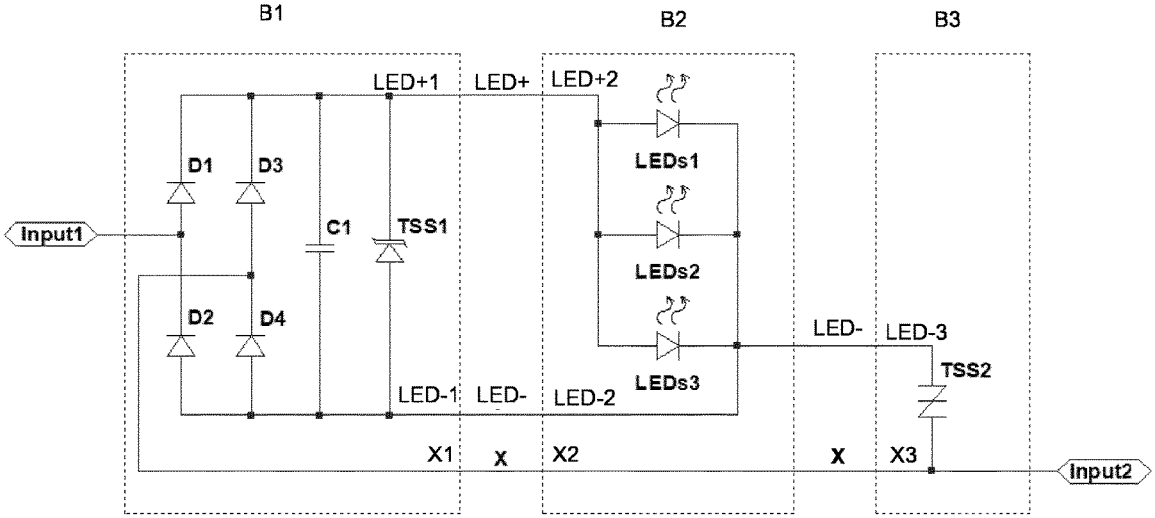
FIG. 4 shows a diagram of a modified implementation of the embodiment of in FIG. 3.

FIG. 4 shows a modified implementation of the embodiment in FIG. 3. The circuit board arrangement is further assembled by a third circuit board B3. The second circuit board B2 now only carries the LED string without the second input Input2 to the ballast and the second voltage suppression element. The second input Input2 to the ballast and the second voltage suppression element TSS2 are placed on the third circuit board B3. Since the said first, second and third circuit boards are placed sequentially along the longitudinal direction of the tubular LED lamp, said first circuit board B1 and the third circuit board B3 are placed in opposite ends of the tubular LED lamp, the second circuit B2 is placed between the first and the third circuit boards. In order to connect the second input Input2/X3 in the third board B3 to the rectifier in the first board B1, the connection has to extend along the tubular lamp. For this, the second circuit board is provided with a wire/terminals X2 to connect the third terminal X3 in the third board and the third terminal X1 in the first board. The second voltage suppression element TSS2 is provided in the third circuit board and connected across a second terminal LED−3 and the third terminal X3/the second input Input2, and the second terminal LED−3 is connected to the second terminal LED−2 in the second board.

In case the third interconnection X of the third terminals, either or both the interconnection of X1 and X2 and the interconnection of X2 and X3, fails, the second voltage suppression element TSS2 would activate. It does not matter in case the interconnection of the second terminals LED− between in the second and third boards fails.

The voltage suppression element can be implemented by a transient surge suppressor, like a thyristor surge suppressors, a glass discharge tube, or a discharge tube, etc., as along as it becomes conductive/substantial zero resistance/impedance when a voltage thereacross reaches a threshold. The first and the second voltage suppression elements, if there are two, can be the same type or different type of devices.

Note that the tubular LED lamp may have other circuit component like pin safety circuit, thermal protection circuit, filament emulation circuit. Those skilled in the art would understand how to arrange those circuit on the lamp, given the enormous prior known technologies. Thus those circuits are not disclosed for simplicity.

Other variations to the disclosed embodiments can be understood and effected by those skilled in the art in practicing the claimed invention, from a study of the drawings, the disclosure, and the appended claims. For example, there are other allocations of the lighting circuit among two, three, or even more circuit boards, and therefore there are other embodiment to place the voltage suppression element at the electrical terminals to prevent arcing, which still fall in the scope of the invention. In the claims, the word "comprising" does not exclude other elements or steps, and the indefinite article "a" or "an" does not exclude a plurality. Those skilled in the art understand that other type of sensing and other type of interference could also be applicable. The mere fact that certain measures are recited in mutually different dependent claims does not indicate that a combination of these measures cannot be used to advantage. Any reference signs in the claims should not be construed as limiting the scope.

The invention claimed is:

1. A circuit board arrangement comprising a first and a second circuit board assembled together, each circuit board comprising:

a portion of a circuit; and a first, a second and a third electrical terminal to be electrically connected to a respective first, second, and third electrical terminal of said each circuit board of the first and the second circuit board thereby forming a first interconnection of the first electrical terminal of the first and the second circuit board, a second interconnection of the second electrical terminal of the first and the second circuit board, and a third interconnection of the third terminal of the first and the second circuit board, so as to couple respective portions of the circuit of the first and the second circuit board, wherein the first and second electrical terminal on the circuit board are coupled with each other via the portion of the circuit on said each circuit board, at least one circuit board of the first and the second circuit board further comprising:

a voltage suppression element connected across the first and second electrical terminal of said each circuit board, said voltage suppression element is adapted to become conductive when a voltage thereacross reaches a threshold;

characterized in that the portion of the circuit comprising at least one LED, and said at least one LED on the first circuit board (B1) and said at least one LED on the second circuit board are series connected, via the third interconnection, and in a same forward direction from the first interconnection to the second interconnection.

2. The circuit board arrangement according to claim 1, wherein the voltage suppression element is adapted to become conductive when a voltage across the series connection of the at least one LED on the first circuit board and the at least one LED on the second circuit board reaches the threshold, thereby preventing an overvoltage/arcing across the first and second electrical terminals due to a disconnection of the series connection of the LED on the first circuit board and the LED on the second circuit board.

3. The circuit board arrangement according to claim 2, wherein the at least one LED on the first circuit board is in a forward direction from the first electrical terminal to the third electrical terminal, the at least one LED on the second circuit board is in the forward direction from the third electrical terminal to the second electrical terminal, thereby the first interconnection of the first electrical terminal of the first and the second circuit board and the second interconnection of the second electrical terminal of the first and the second circuit board are in series connection with each other via a third interconnection (A), and a LED current is adapted to flow from the first interconnection, through the at least one LED on the first circuit board, through the third connection, through the at least one LED on the second circuit board, and to the second interconnection.

4. The circuit board arrangement according to claim 3, wherein the voltage suppression element is adapted to is adapted to become conductive when a voltage across the third interconnection reaches the threshold, thereby preventing an overvoltage/arcing across the first and second electrical terminal of the first and the second circuit board due a disconnection of the third interconnection.

5. The circuit board arrangement according to claim 3, wherein the first circuit board comprises:

a first input adapted to connect to a first output of an AC power supply;

a first half of a rectifier, connected with the first input and with a positive line and a negative line, wherein said positive line and the negative line are connected to the first and second terminal of the first and the second circuit board respectively;

a first LED path connected from the positive line to the third electrical terminal;

and the second circuit board comprises:

a second input adapted to connect to a second output of the AC power supply;

a second half of the rectifier, connected with the second input and with the positive line and the negative line, wherein said positive line and the negative line are connected to the first and second terminal of the first and the second circuit board respectively;

a second LED path connected from the third electrical terminal to the negative line; wherein each of the first LED path and the second path comprises a plurality of LEDs.

6. The circuit board arrangement according to claim 5, wherein the first circuit board comprises:

a first of the voltage suppression element connected across the positive line and negative line, and adapted to prevent the overvoltage/arcing in case of the third interconnection of the third electrical terminal of the first and the second circuit board fails; and the second interconnection of the second electrical terminal of the first and the second circuit board fails and the second input has a positive phase of the AC power supply;

and/or the second circuit board comprises:

a second of the voltage suppression element connected across the positive line and negative line and adapted to prevent the overvoltage/arcing in case of:

the third interconnection of the third electrical terminal of the first and the second circuit board fails; and the first interconnection of the first electrical terminal of the first and the second circuit board fails and the second input has a positive phase of the AC power supply.

7. The circuit board arrangement according to claim 1, wherein the voltage suppression element is further adapted to become conductive when a voltage across the first interconnection or the second interconnection reaches the threshold, thereby preventing an overvoltage/arcing due a disconnection of the first interconnection or a disconnection of the second interconnection.

8. The circuit board arrangement according to claim 1, wherein the voltage suppression element is adapted to become zero resistance when the voltage thereacross reaches the threshold, the voltage suppression element comprises a transient surge suppressor, a glass discharge tube, or a discharge tube, said first terminal of the first and the second circuit board are connected by soldering, wiring or connector, said second terminal of the first and the second circuit board are connected by soldering, wiring or connector, and said third terminal of the first and the second circuit board are connected by soldering, wiring or connector.

9. A tubular LED lamp, comprising the circuit board arrangement according to claim 1.

10. The tubular LED lamp according to claim 9, being used with an electronic ballast for fluorescent lamps.

11. The tubular LED lamp according to claim 10, wherein said first circuit board and the second circuit board are placed sequentially along a longitudinal direction of the tubular LED lamp, and the first terminal of the first and the second circuit board and the second terminal of the first and the second circuit board are connected at a longitudinal location in the tubular LED lamp with a distance from the ends of the tubular LED lamp.

* * * * *